US005842240A

United States Patent [19]

Kato et al.

[11] Patent Number: 5,842,240

[45] Date of Patent: Dec. 1, 1998

[54] FITTING FOR AN APPLIANCE SUCH AS A SINK

[75] Inventors: Hisanori Kato, Frankfurt; Ryunosuke Takahashi, Niederkruchten; Klaus Steinmetz, Halver; Joachim NieHaus, Porta Westfalica, all of Germany

[73] Assignee: YKK Corporation, Tokyo, Japan

[21] Appl. No.: 664,152

[22] Filed: Jun. 14, 1996

[30] Foreign Application Priority Data

Jun. 16, 1995 [GB] United Kingdom ..... 9512336
Feb. 13, 1996 [GB] United Kingdom ..... 9602927

[51] Int. Cl.[6] ..... E03C 1/33

[52] U.S. Cl. ..... 4/633; 24/306; 24/442

[58] Field of Search ..... 4/631–636; 24/306, 24/442, 265 H; 312/140.1, 140.3, 140.4, 228

[56] References Cited

U.S. PATENT DOCUMENTS 2,812,521 11/1957 Skinner ..... 4/636
3,229,310 1/1966 Ensch .
3,680,152 8/1972 Farrell ..... 4/633
5,544,387 8/1996 Yamamoto ..... 24/306 X

FOREIGN PATENT DOCUMENTS 0 678 468 1/1966 Belgium .
0 128 772 12/1984 European Pat. Off. .
0 674 055 12/1994 European Pat. Off. .
3 110 134 10/1982 Germany .
2 219 498 12/1989 United Kingdom .

*Primary Examiner*—Charles E. Phillips
*Attorney, Agent, or Firm*—Hill, Steadman & Simpson

[57] ABSTRACT

A fitting for an appliance such as a sink extends between an anchor means (16,112) on the appliance and another anchor means (32,114) on a worktop. The appliance can be fitted easily to the worktop, and can aslo be removed quickly.

4 Claims, 4 Drawing Sheets

FITTING FOR AN APPLIANCE SUCH AS A SINK

The present invention relates to a fitting for fixing an appliance on a worktop, and in particular to a fitting for fixing an appliance such as a sink or basin in place in a cut out in a worktop.

Existing fittings for fixing a sink in place on a worktop typically comprise a two part hook arrangement. Once part is attached to an eye or hanger on the sink, and the other grips the underside of the work top. The parts are pulled together by a screw to pull the rim of the sink onto the work top surface. This holds the sink in place and an elastomeric seal is clamped between the rim and work top surface to provide a water tight seal.

The prior art fittings are expensive, being formed of small metal parts of complex shape and high stiffness, and they are difficult to manipulate in the confines of the cupboard space beneath the sink. Adjustment of the sink during installation is difficult, and the screws may corrode, making it difficult or impossible to release the sink without breaking the fittings or the hanger on the sink.

A first aspect of the present invention provides a fitting for fixing an appliance to a worktop, the appliance having a rim which bears on the worktop surface, the fitting comprising: a first anchor means secured, in use, to one of the appliance or the worktop; a second anchor means secured, in use to the other of the appliance or the worktop; and a strap of surface fastener material; the strap extending, in use, between the first anchor means and the second anchor means thereby fixing the appliance to the worktop.

A second aspect of the present invention provides a fitting for fixing an appliance, to a worktop, the appliance having a rim which bears on the worktop surface, the fitting comprising a surface fastener, a first part of the fastener being attached to the underside of the appliance near the rim, and the second part of the fastener being attached to the worktop below the level of the worktop surface, the first and second parts of the fastener being brought together to fix the appliance in place.

A third aspect of the present invention provides a method of fixing an appliance relative to a cut out in a worktop, the appliance being supported on the worktop surface, the method comprising: attaching a first part of a surface fastener the underside of the appliance, attaching a second part of the surface fastener to a wall of the cut out in the worktop, below the level of the worktop surface, pulling the first part of the fastener downward to urge the appliance against the worktop, and pressing the first and second parts of the fastener together while the first part is under tension.

A fourth aspect of the present invention provides a fitting for fixing an appliance to a worktop, the appliance having a rim which bears on the worktop surface, wherein the fitting comprises a strap of surface fastener material; a first anchor means for attaching the strap to the appliance or the worktop; and a second anchor means for attachment to the other of the appliance and the worktop, the strap extending, in use, about the second anchor means and being locked about the second anchor means to fix the appliance on the worktop.

In a preferred embodiment the fastener is a hook and loop fastener. In a particularly preferred embodiment the first part of the fastener is the loop part and the second part of the fastener is the hook part.

In a preferred embodiment the fitting has a channel for receiving a seal.

Preferably the fastener is oriented so that the force holding the appliance rim against the worktop acts substantially in the direction of shear of the fastener.

Preferably the loop side of the fastener has a flexible base material, and in particular has an elastic base material.

Preferably the hook side of the fastener is substantially rigid. The hook side may be injection moulded, with a body portion which is attached to the worktop and hooks which are integrally moulded on an engagement surface of the body portion.

The hook and loop fastener can be readily released by peeling apart the hook and loop parts and is resistant to corrosion. Thus, the invention provides a fitting which is easy to operate in the confined space beneath the appliance and allows the appliance to be removed and adjusted easily.

The invention is particularly suited to fixing a sink or wash basin in place in a cut out in the work top. It may also be suitable for other appliances such as cooker hobs.

Other, preferred, features of the invention will be apparent from the following description and the accompanying claims.

The invention will be further described in way of example only, with reference to the accompanying drawings, in which.

Figure 2:
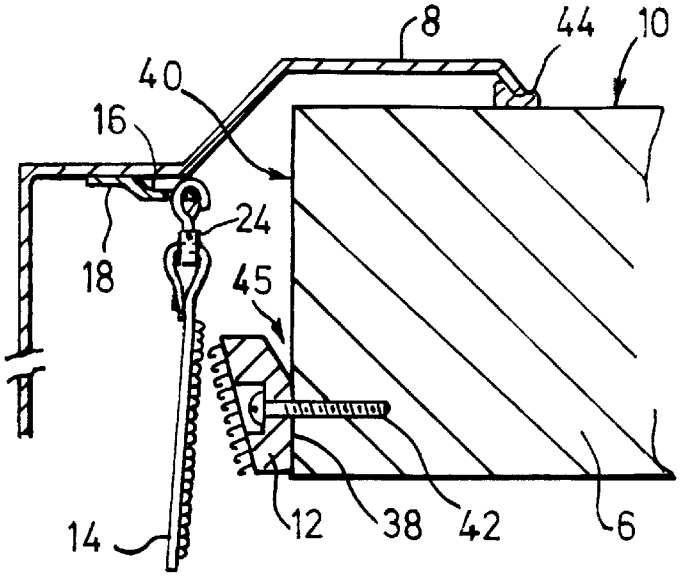
FIG. 2 is a detail on circle A of FIG. 1, illustrating a first embodiment of the invention.
Figure 5A:
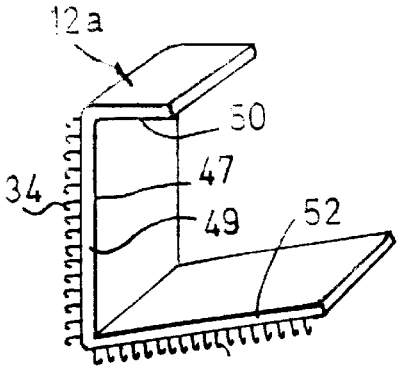
Figure 5B:
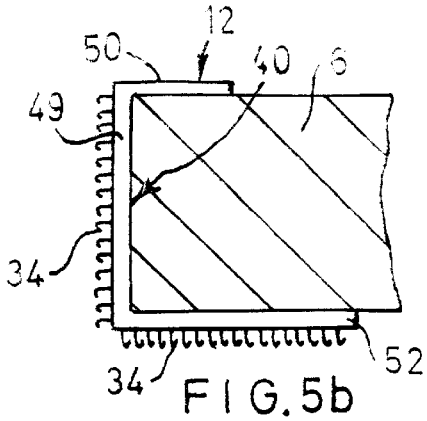
Figure 6:
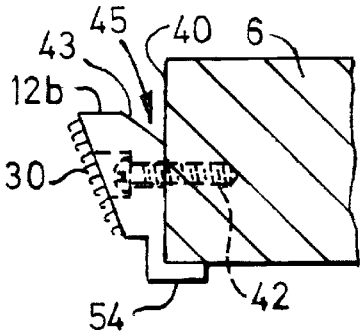
Figure 7:
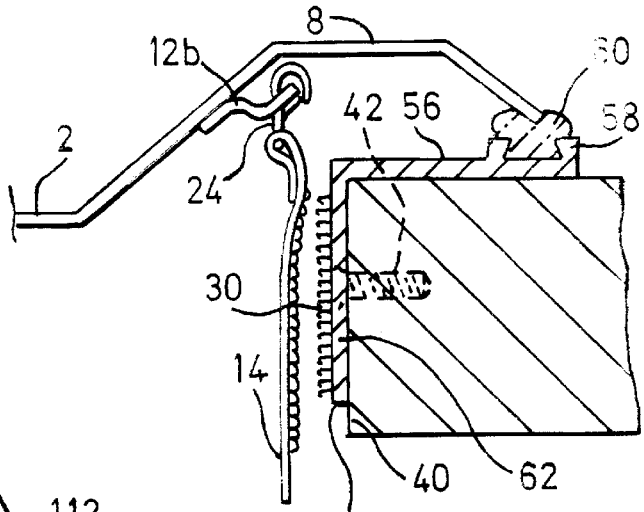
Figure 8:
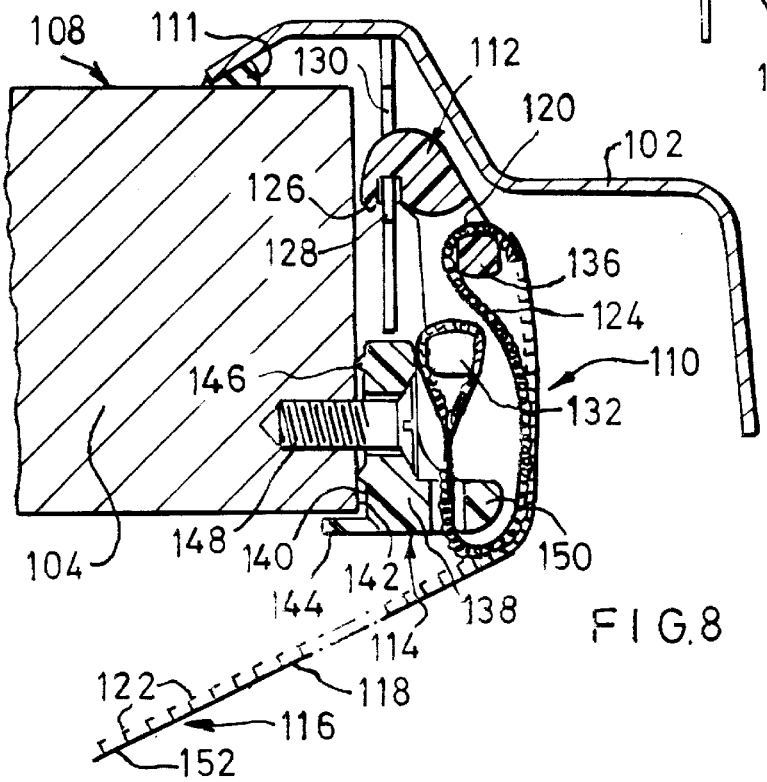
Figure 9:
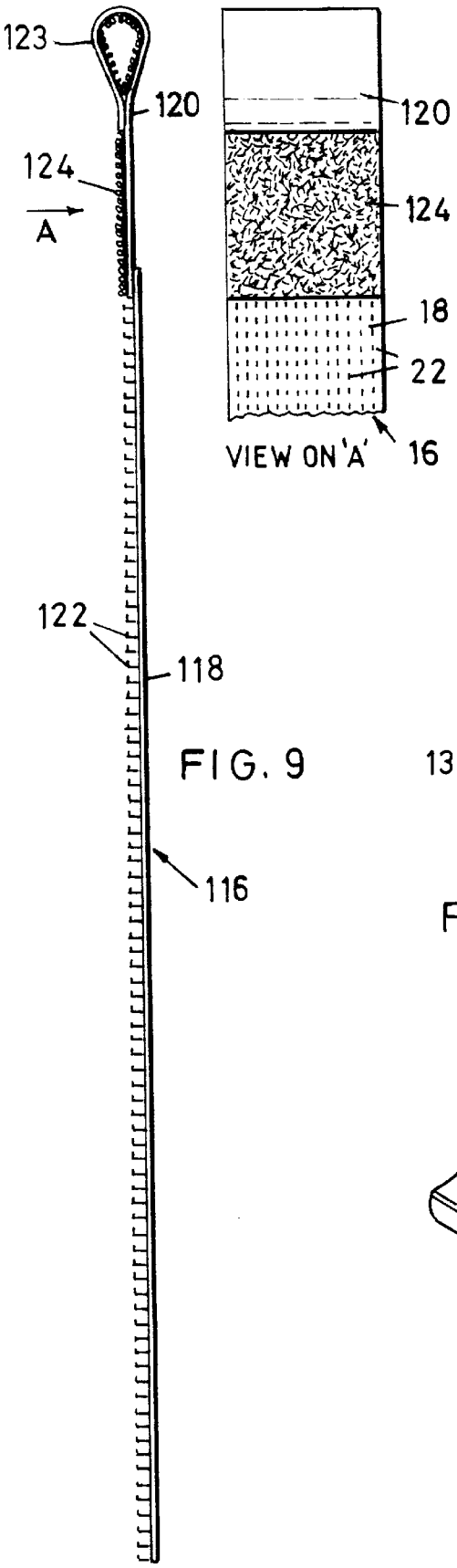
Figure 10:
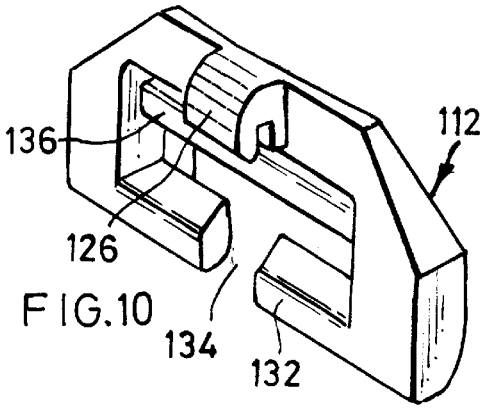
Figure 11:
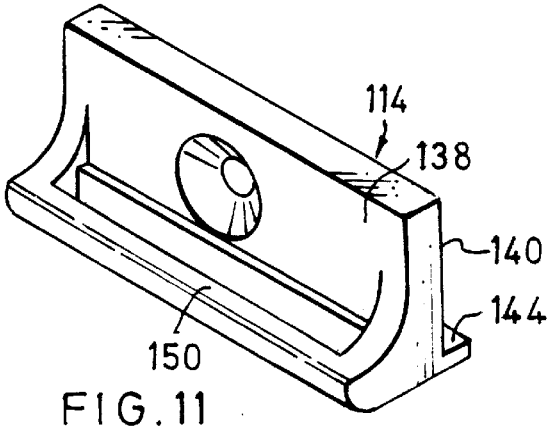
Figure 12:
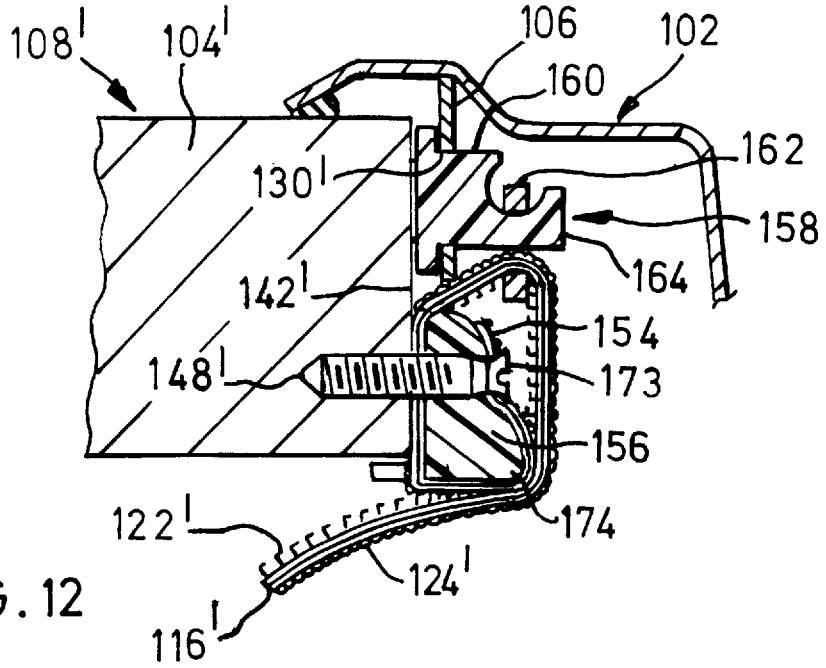
Figure 13:
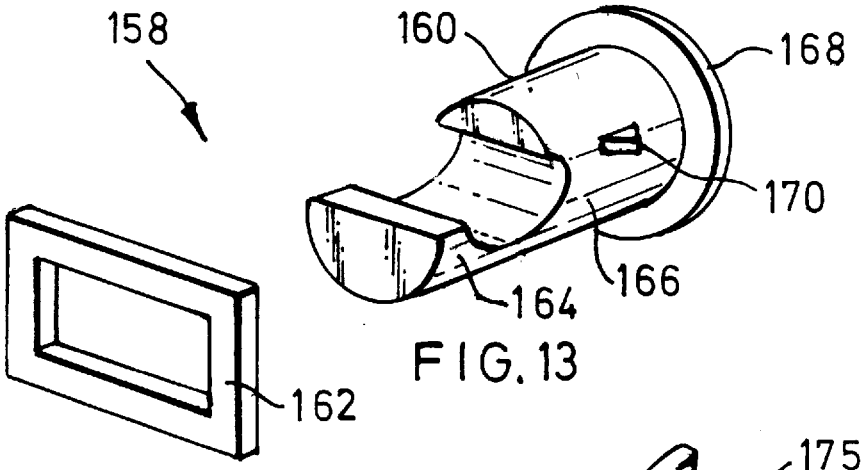
Figure 14:
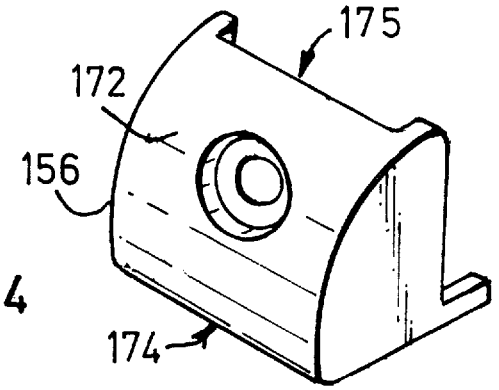

FIGS. 5*a* and 5*b* illustrate a first modification of the embodiment of FIG. 2;

FIG. 6 illustrates a second modification of the embodiment of FIG. 2;

FIG. 7 illustrates a second embodiment of the invention;

FIG. 8 shows in cross-section a fitting forming a third embodiment of the invention and used for fixing a sink to a worktop, FIG. 9 shows a strap of the fitting of FIG. 8, FIG. 10 shows a first anchor means of the fitting of FIG. 8, FIG. 11 shows a second anchor means of the fitting of FIG. 8, FIG. 12 shows in cross-section a fitting forming a fourth embodiment of the invention, FIG. 13 shows a first anchor means of the fitting of FIG. 12, and FIG. 14 shows a second anchor means of the fitting of FIG. 12.

Figure 1:
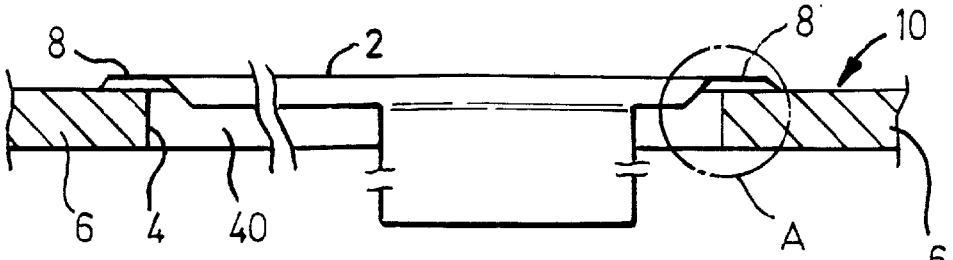
FIG. 1 illustrates in cross-section a sink mounted on a worktop.

FIG. 1 shows a sink 2 which is mounted in a cut-out 4 in worktop 6. A rim 8 of the sink bears on the upper surface 10 of the worktop. The sink is fixed in place by a fitting which pulls the sink rim 8 down on to the worktop upper surface 10. This arrangement is well known.

Figure 3:
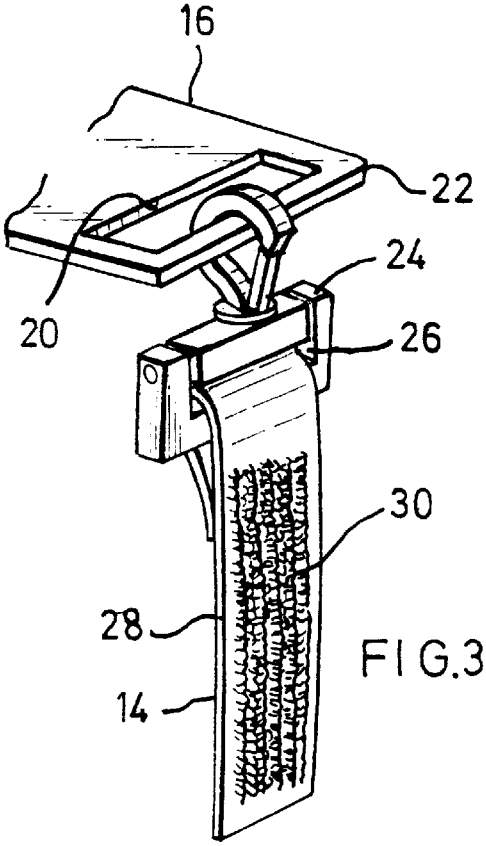
FIG. 3 is a perspective view which illustrates the attachment of a loop side of a hook and loop fastener of the embodiment of FIG. 2 to the sink.
Figure 4:
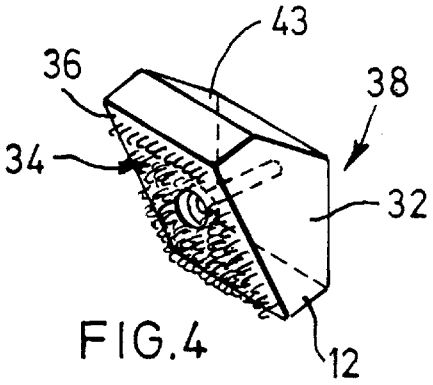
FIG. 4 is a perspective view of a hook side of the hook and loop fastener of the embodiment of FIG. 2.

FIGS. 2 to 4 show a fitting forming a first embodiment of the invention, utilising a hook and loop fastener 12, 14 for fixing the sink 2 in place. A hanger 16 is attached at one end 18 to the underside of the sink 2 near the rim 8, for example by spot welding, and has an eye 20 at a free end 22.

The loop side 14 of the hook and loop fastener is fixed to the eye 20 by a releasable hook 24 which has an eye 26. The hook allows swivelling and pivoting movement of the eye 26 relative to the hanger 16. Such hooks are marketed, for example, by YKK Corporation under the reference number LN-R. The backing material 28 of the loop side 14 is secured in place around the eye 26, for example by stitching. Preferably the backing material 28 is of stretchable elastic material such as a polymer material and has nylon loops 30 woven into the material 28 as is well known in the art.

The hook side 12 of the fastener is an injection moulded tapered block 32 of thermoplastic synthetic resin material having hooks 34 integrally moulded on an engaging surface 36 which forms an acute angle with a back surface 28. The block 32 is fixed to the wall 40 of the cut out 4 in the worktop 6 by a screw 42.

An elastomeric seal 44 is sandwiched between the rim 8 and worktop surface 10.

With some hook and loop fasteners, water can soften the material, particularly nylon loop material, and so cause the fastener to lose it strength.

The top of the block 32 has a sloping surface 43 facing the wall 40, to form a drain or gutter 45. If any water penetrates the seal 44 to flow down the wall 40, it will be directed away from the engaged hooks and loops 34, 30.

To install the sink 2, the user is provided with a template to make the cut out 4 of the required size and shape. The position of the hook blocks 32 are marked on the template and correspond to the position of the hangers 16 on the underside of the sink 2. The blocks 32 are fixed in position by screws 42, and the loop side parts 14 are booked on the hangers 16. The sink is then lowered into the cut out 4, with the seal 44 being positioned between the rim 8 and worktop surface 10. The loop side parts 14 are then pulled downwards to urge the rim 8 against the worktop surface, stretching the loop side part 14 and causing some compression of the seal 44. The loop side part 14 is then pressed against the hook 34 on the engaging surface 36 of the block 32, to engage the hook and loop fastener 12, 14.

The upward force at the seal 44, and the stretching of hook side backing material 28, applies a shearing force to the hook and loop fastener 12, 14 in the plane of the engaging surface 36. Hook and loop fasteners provide a strong gripping force when used in this mode and so the sink is held firmly in place.

To release the sink 2, the fasteners 12, 14 are released by peeling the loop side 14 away from the hook side 12, which can be achieved with a much lower force.

The hook and loop fasteners 12, 14 are formed of synthetic polymer materials are resistant to corrosion, allowing the sink to be readily released and re-fixed. Also, the fasteners themselves may be readily replaced if required and are relatively expensive to produce.

While the fastener is preferably configured so that the separating force on the fastener acts in shear, hook and loop fasteners will also function effectively when used in tension, ie. a force perpendicular to the engaging surfaces. It will be appreciated by those skilled in the art that a wide variety of loop sizes and hook designs are available, and the particular designs used will be selected to meet the anticipated forces on the fastener.

FIGS. 5*a* and 5*b* show a modification of the hook side fastener 12*a*. The hook side fastener 12*a* is moulded in the form of a clip having a resilient J-shaped body 47. The body 47 has a central web 49 and opposite walls 50, 52 which are angled towards one another. The walls 50, 52 are then spread apart to grip the edge of the cut out 4, Hooks are moulded on the web 49 the lower wall 52 so that the loop side part 14 may be wrapped around the hook side part 12*a*. The part 12*a* may be secured to the worktop additionally by a screw (not shown) or adhesive.

In the modification of FIG. 6, the hook side part 12*b* is similar to the embodiment of FIGS. 2 and 4, but has a lip 54 which bears on the underside of the worktop 6.

In the modification of FIG. 7, the hook side part 12*c* includes an upper wall 56 with a channel 58 which locates a waterproof seal 60 on which the rim 8 bears. The upper wall 56 extends around the perimeter of sink 2. Engaging parts 62 having integrally moulded hooks 30 and extend down from the upper wall 56 in the region of the hangers and are fixed to the wall 40 of the cut-out 4 by screws 42.

Where the hook side part engaging surface is vertical the hanger 16 is preferably positioned vertically above or overlapping the engaging surface so that the force applied to the fastener is still in shear. In particular, it is desirable to avoid any tendency to peel the loop side part 14 from the hook side 12 part when the fittings are in place.

FIG. 8 shows a rim portion 102 of a sink which is mounted in a cut-out in a worktop 104. The sink hanger 106 which is attached to the underside of the rim 102, for example by spot welding, as well known in the art.

The sink rim 102 is pulled down on to the worktop surface 108 by a fitting 110 forming an embodiment of the invention. An elastomeric seal 111 is sandwiched between the rim 102 and surface 108. The fitting 110 comprises a first anchor 112 secured to the hanger 106, a second anchor 114 secured to the worktop 104, and a strap 116 of hook and loop fastener material which is used to pull and hold the anchors 112, 114 together, the strap 116 being in tension.

Referring to FIG. 9, the strap 116 has two parts 118, 120 which are integrally formed and which carry, respectively, hooks 122 and loops 124. The hook section 118 has a base of plastics, such as nylon, on which hooks 122 are moulded. The loop section 120 has a woven plastics base of, for example, polyester and loops 124 woven into the base. The hook and loop structures are well know in the art. The sections 118, 120 are joined together by welding.

A loop 123 is formed a the free end of the loop section 120, by welding the mating parts of the loop section together.

The first anchor 112, shown in FIG. 10, is of moulded plastics material and has a hook 126 which hooks over the lower edge 128 of an eye 130 in the hanger 106. A lower bar 132 of the anchor 112 has an opening 134 so that the loop 122 can be eased onto the bar 132 to fasten the strap to the anchor 112. An upper bar 136 runs parallel to lower bar 132.

The second anchor 114, shown in FIG. 11, is of moulded plastics material and has a body 138 with a flat face 140 which mates against the wall 142 of the worktop cut-out, as seen in FIG. 8. A lip 144 passes underneath the worktop position the anchor 114, and nibs 146 on the face 140 help to locate the anchor 140 during fixing. The anchor is fixed in place by a screw 148. A bar 150 is formed on the anchor 114.

To use the fitting 110, the anchor 114 is fixed in place on the wall 142 of the cut-out. The loop 122 of the strap 116 is eased over the bar 132 of anchor 112 so that the strap is attached to the work top 104. The free end of the strap 116 is fed around the bar 150 and then back around the bar 136, so that the hook and loop surfaces are facing one another as shown in FIG. 8. The anchor 112 is then hooked over the hanger 106 and the free end 152 of the strap 116 is pulled downward to draw the anchors 112, 114 together, pulling the rim 102 onto the worktop surface 108. The hooks 122 of the hook part 118 of the strap 116 are then pressed against the loops 124 of the loop part 120 to lock the strap.

It will be appreciated that the length of the loop part 120 of the strap must be gauged to ensure mating with the opposed hook part 118. Work top thickness' are generally to a recognised standard and so this can be readily achieved.

As an alternative, a strap having mixed hooks and loops may be used if sufficient strength can be achieved.

When locked, the hook and loop fastener 116 is working in shear at the mating surfaces, and such fasteners are particularly strong when used in this fashion, the hooks facing upwards towards the sink rim 102. If the hook and loop parts 118, 120 are in opposite positions, the hook part incorporating the closed loop 123, the hooks would preferably face downwards at the mating sections.

To release the fitting, the hook part 118 is peeled away from the loop part 20, which requires a relatively low separation force.

In the embodiment of FIG. 12, a strap 116' of hook and loop material has hooks 122' formed all along one side 118', and loops 124' on the other side 120'. The strap 116' can be made by gluing together sheets of hook material and loop material, as is well known in the art.

The strap 116' is anchored at one end by sandwiching it between the side wall 142' of the worktop cut out and a first anchor 156 which is attached to the worktop by a screw 148'.

A second anchor 158 is mounted on the hanger 106 and comprises a plastics stub 160 which projects through a circular eye 130' in the hanger 106, and a plastics loop 162 which is held on a hook 164 of the stub 160.

The stub 160 has a barrel portion 166 which is a close fit in the eye 130', and a lip 168 to prevent the stub being pulled through the hanger aperture 130'.

Nibs 170 on the other side of the barrel portion 166, help hold the stub 160 in place in the hanger eye 130'.

In use, the second anchor 158 is pushed through the hanger eye 130', and the sink then lowered into the worktop cut-out. The strap 116' is attached to the worktop by the first anchor 156. The strap is shown with one end 154 held on the outer surface 172 of the anchor by the head 173 of the screw 148', and the strap 116' then passes underneath the anchor 158' and between the anchor 158' and cut-out wall 142'. The rear wall 175 of the anchor 156 is angled away from the cut-out wall 142', above the level of the screw 148'.

The strap 116' is passed through the loop 162 which is hooked over the hook 164. The strap 116' is pulled downward and pressed against the end 154 to lock the strap.

Preferably, the anchor is wedge shaped, the outer surface 172 sloping towards the cut-out wall 142 in the upwards direction. Also, a corner 174 is formed a the lower, outer edge of the anchor 156, the free end of the strap 116' passing around the corner 174 to lock with the end portion 154 on the underside of the anchor 156.

It will be appreciated that the two-part anchor 158 may be a single plastics moulding in the form of a hook, similar to anchor 112 of the first embodiment.

A hook material having moulded hooks is preferred. Also, the hooks may face in two (or more) directions for additional binding strength between the hook and the loop surfaces. A strap having mixed hooks and loops could also be used, in which case the upward run of the strap could pass over the outer face 172 of the anchor 156.

When the appliance is not provided with hangers 106, 106', the anchor 112, 160 will be adapted to grip or bear on a flange or formation on the appliance.

Various modifications may be made to the desired embodiments, and it is desired to include all such modifications as fall within the scope of the accompanying claims.

We claim:

1. A fitting for fixing an appliance to a worktop, the appliance having a rim which bears on an upper surface of the worktop, the fitting comprising:

a first part of a hook and loop fastener attached to the underside of the appliance near the rim;

a second part of the hook and loop fastener attached to the worktop below the level of the upper surface, the second part having a wedge shaped body with one of the first and second parts of the hook and loop fastener molded on at least one face thereof, the face being in use, at an angle to the plane of the upper surface; and the first and the second parts of the hook and loop fastener being brought together to fix the appliance to the upper surface.

2. A fitting as claimed in claim 1, and including means integral with the fitting for directing water away from mating surface(s) of the hook and loop fastener.

3. A fitting as claimed in claim 1, wherein the appliance is a sink or basin.

4. A fitting as claimed in claim 1, in which the first part of the hook and loop fastener is the loop part and the second part is the hook part.

* * * * *